US009140450B2

(12) United States Patent
Jacklich et al.

(10) Patent No.: US 9,140,450 B2
(45) Date of Patent: Sep. 22, 2015

(54) RETROFITTED CORROSIVE RESISTANT VENTING SYSTEM

(75) Inventors: John Jacklich, Napa, CA (US); Eric Adair, Dixon, CA (US)

(73) Assignee: M&G DuraVent, Inc., Vacaville, CA (US)

( * ) Notice: Subject to any disclaimer, the term of this patent is extended or adjusted under 35 U.S.C. 154(b) by 965 days.

(21) Appl. No.: 12/427,576

(22) Filed: Apr. 21, 2009

(65) Prior Publication Data

US 2010/0267327 A1 Oct. 21, 2010

(51) Int. Cl.
*F23J 13/02* (2006.01)
*F23J 13/04* (2006.01)

(52) U.S. Cl.
CPC ..... *F23J 13/025* (2013.01); *F23J 13/04* (2013.01); *F23J 2213/101* (2013.01); *F23J 2213/203* (2013.01); *F23J 2213/204* (2013.01); *F23J 2900/13004* (2013.01); *F23J 2900/13021* (2013.01); *Y10T 29/53* (2015.01)

(58) Field of Classification Search
CPC ..... F23J 13/025; F23J 13/04; F23J 2213/101; F23J 2213/203; F23J 2900/13004; F23J 2900/13021; F23J 2213/204; Y10T 29/53
USPC ..... 454/41, 44; 285/47
See application file for complete search history.

(56) References Cited

U.S. PATENT DOCUMENTS

| | | | | | |
|---|---|---|---|---|---|
| 530,229 | A * | 12/1894 | Lange | 454/35 |
| 2,277,436 | A * | 3/1942 | Howle | 52/249 |
| 2,687,127 | A * | 8/1954 | Leffler | 126/307 R |
| 4,306,491 | A * | 12/1981 | Reardon, Jr. | 126/307 R |
| 4,846,147 | A * | 7/1989 | Townsend et al. | 126/307 R |
| 5,494,319 | A * | 2/1996 | Thomas | 285/55 |
| 6,234,163 | B1 * | 5/2001 | Garrod | 126/80 |
| 2007/0221195 | A1 * | 9/2007 | Bibaud et al. | 126/80 |
| 2008/0220709 | A1 * | 9/2008 | Meredith | 454/44 |

OTHER PUBLICATIONS

California Real Estate Inspection Association, Jan. 2011, http://www.creia.org/January-2011-Inspector-eNews/common-venting-of-gas-appliances.html.*

* cited by examiner

*Primary Examiner* — John K Fristoe, Jr.
*Assistant Examiner* — Umashankar Venkatesan
(74) *Attorney, Agent, or Firm* — Vierra Magen Marcus LLP

(57) ABSTRACT

A venting system and a method for installing the venting system. A non-flexible metallic venting pipe comprises a chase. A first end of the vent pipe is positioned adjacent an appliance installation and a second end positioned at an exit to an external region of a home. A flexible vent tube comprising a sealed non-corrosive material, having a first end and a second end, is positioned between the first end of the venting pipe and the second end of the venting pipe. Adapters are positioned at the ends of the venting pipe. A method comprises routing a flexible venting tube comprising sealed, corrosion resistant venting material through an existing non-flexible double-walled vent comprising non-sealed material.

9 Claims, 5 Drawing Sheets

RETROFITTED CORROSIVE RESISTANT VENTING SYSTEM

BACKGROUND

Vent systems are used with various types of exhaust producing appliances. Generally, vent systems operate as negative draft systems or as positive pressure systems.

Vent systems are divided into various categories. A Category I vent system operates with a negative draft, and the products of combustion are hot enough to stay well above dew point. Since a major portion of gas flue products is water vapor, condensing can occur when the flue products are allowed to cool below dew point. This can cause corrosion if the wrong materials are used in the vent system. A Category I vent system is typically vented with Type "B" vent materials.

A Category II vent system also operates with a negative pressure in the vent, but the temperature of the flue products has cooled to a point where they may condense into a liquid in the flue. A Category II vent requires vent materials that are resistant to the corrosive effects of flue gas condensate.

Category III and IV vent systems operate with a positive pressure in the vent system. Positive pressure vents must be fully sealed to prevent spillage of flue products into an occupied portion of the building. A Category III vent system maintains flue gas temperatures above dew point and should not condense in the flue. A Category IV vent system's flue products cool below their dew point, therefore it is possible they may condense in the flue.

Material selection and sizing for the vent system of a Category II, III or IV boiler is determined by the information contained in the manufacturer's installation instructions, which is based on performance testing under the requirements of the ANSI standard.

All vent systems other than Category I generally use heat and corrosion resistant materials, which are typically more expensive. Category IV vent materials are typically fully sealed and constructed from heat and corrosion resistant stainless steel to withstand the possible corrosive effects from acidic flue gas condensate.

SUMMARY

The technology, roughly described, includes a method for creating a venting system for an appliance. The method includes routing a flexible venting tube comprising a Category II, Category III or Category IV compliant venting material through an existing non-flexible vent comprising a Category I material and coupling the first end of the flexible venting tube to the appliance and the second end of the venting tube to an outlet.

In a further aspect, the technology comprises a venting system. The system includes a non-flexible metallic venting pipe comprising a chase. The chase includes a first end positioned adjacent an appliance installation and a second end positioned at an exit to an external region of a home. A flexible vent tube comprising a sealed non-corrosive material is provided in the chase. The flexible vent tube has a first end and a second end and is positioned between the first end of the venting pipe and the second end of the venting pipe. A first adapter is positioned at the first end of the venting pipe; and a second adapted is positioned at the second end of the venting pipe.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Technology is presented enabling a venting system for use with an appliance requiring Category II, III or IV venting specifications. The system utilizes existing venting materials installed in a building to provide clearance and ease in the installation of a venting system suitable for the appliance.

Figure 1:
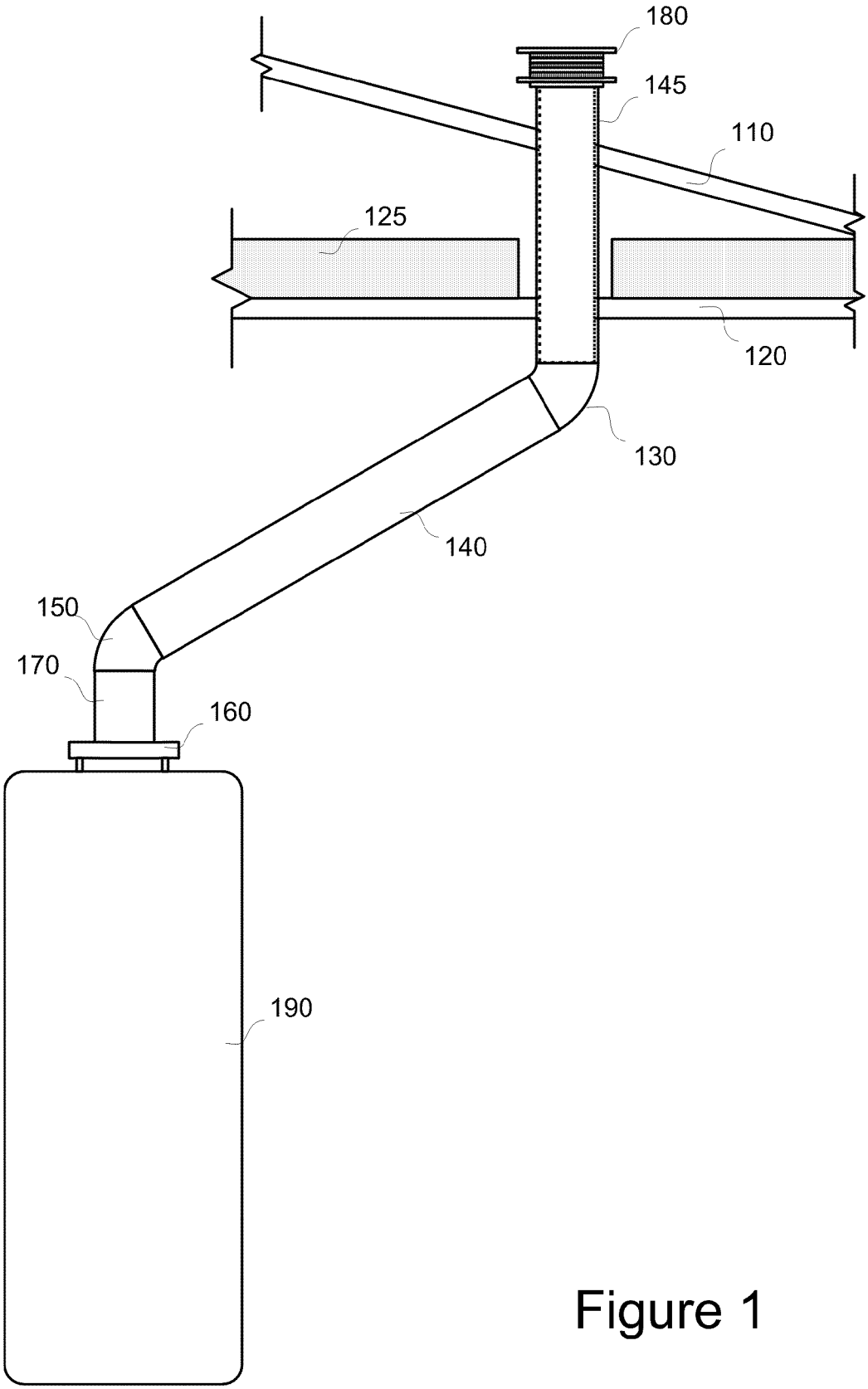
FIG. 1 depicts a conventional category I appliance and category I venting system.

FIG. 1 depicts a Category 1 venting system 100 coupled to an appliance 190. The category I system may be comprised of single or double walled pieces 130, 140, 150, 170 in areas where no combustibles are present, but generally, a double walled portion 145 will be provided through any combustibles such as ceiling insulation 125, ceiling material 120 or roofing material 110. Double walled portion 145 is typically known as Type-B vent and is suitable for Category I venting purposes. Generally, venting specifications call for at least one inch of clearance between the double walled category I material and such combustibles. Procedures for correctly sizing vents and connectors is published by NFPA in a publication entitled, *NFPA* 54*: National Fuel Gas Code* (*NFGC*). The standard for category I gas vents are provided in UL 441, Gas Vents. Standards for venting gas appliances are provided in UL 1738, the United Laboratories Standard for Safety Venting Systems for Gas-Burning Appliances, Categories II, III, and IV-Second Edition; Reprint with Revisions Through and Including Dec. 6, 2000. The vent system terminates in a vent cap 180 on the exterior of a building. Generally the vent cap 180 is sized to couple directly to the vent cap 180.

Other components, such as a storm collar for the exterior of the building, fire stop at the ceiling, and appliance details, are not illustrated in FIG. 1.

Figure 2:
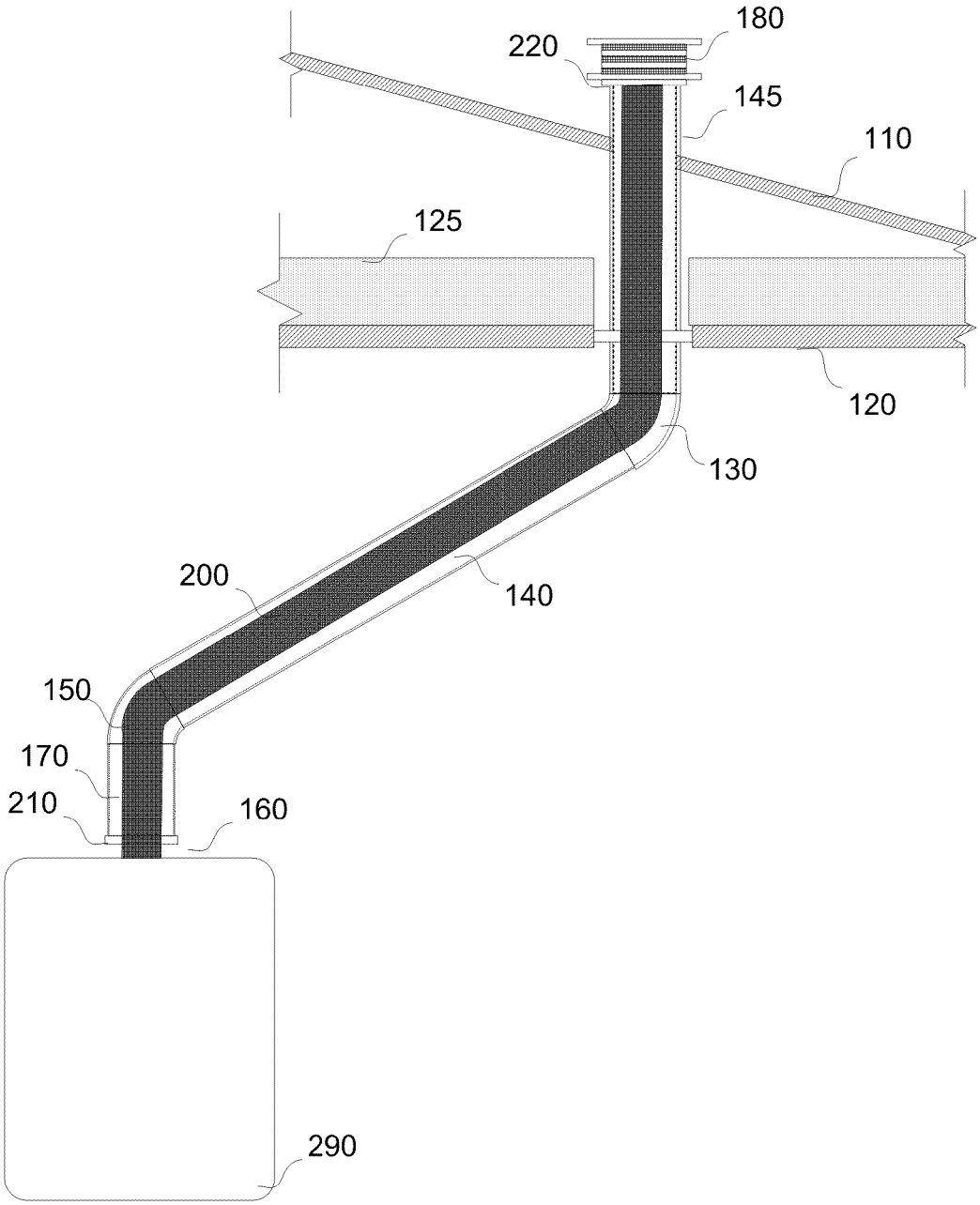
FIG. 2 depicts a conventional Category II, III or IV appliance with the venting system described herein.

FIG. 2 illustrates a first embodiment of the present technology. In accordance with the technology, an existing category I venting system 100 is used as a chase and an internal venting material 200 comprising a heat and/or corrosion resistant venting element 200 having a diameter smaller than that of the existing material venting components 130, 140, 145, 150, 170 is inserted into the existing system 100.

Combined with the use of a first adapter 210 and a second adapter 220, the venting system comprising venting element 200 and existing system 100 allows coupling a Category II, III or IV appliance through the existing system to the vent cap 180 with relative ease. This allows conversion of, for example, an existing water heater to a "tankless" water heater and improves energy efficiency of a building.

Internal vent element 200, in one embodiment, comprises a flexible venting material comprising a heat and/or corrosive resistant material suitable for use in Category II, III or IV systems. Material which is suitable for use in such systems includes AL29-4C stainless steel and Type 444 Stainless steel. Commercial products suitable for use as vent material 200 include varieties of Type 446, 447, 448, 304, and 316 stainless steels.

Typically, a venting system in accordance with the present technology will be necessitated by replacement of the Category I appliance with a different type of appliance. During installation, the existing vent system is uncoupled from the gas appliance. Likewise, the vent cap 180 is decoupled from the existing vent system. The venting material 200 is then snaked though the existing system using the existing system as a chase until the lead end of the material reaches the end of the vent system near the vent cap 180.

It will be understood that the vent system 100 may be comprised of various types of materials having different cross sections. In one embodiment, the vent pieces have circular cross-sections. In an alternative embodiment, the vent pieces have oblong cross sections.

Vent material 200 is comprised of a vent material having a diameter or cross-section suitably sized to fit within all components of the vent system 100. The difference between the cross-sectional size of the vent system 100 components and that of the vent material 200 can be as small as minimal as that sufficient to allow the flexible vent pipe to fit inside the interior of the exterior vent pipe. Typical type-b vent installations range from diameters of 3" to 8". Flexible material suitable for use as vent material 200 includes DuraFlex brand flexible stainless steel products from Simpson Duravent Corporation.

Once vent material 200 is positioned in vent system 100, a first end of the material may be coupled to a Category II, III or IV appliance 290, while the second end is coupled to the vent cap 180. In one embodiment, the vent material 200 may be coupled directly to the apparatus coupling on the appliance 290 and the vent cap 180. Vent cap 180 may need to be adapted from the larger diameter coupling of the existing vent system 100 to the smaller sized coupling of the vent material 200. Typically coupling to the vent cap 180 will require a sizing adapter, such as that shown in FIGS. 3-4B, since the size of the vent cap coupling will have been sized for the original vent pipe 145. Alternatively, a specially sized vent cap may be coupled to the vent material 200, replacing the vent cap 180. It will be recognized that additional Category II, III or IV venting material may be provided at the end of the vent section. In particular, the upper vent adapter 220 have one side coupled to seal the end of the existing system 100, while the second side is coupled to a rigid vent section of Cat II, III, IV pip (not shown) to which is attached cap 180. This embodiment allows an extension of the new vent system which may exceed the height of the existing vent system.

It will be recognized that a gap now exists between the exterior of vent material 200 and the interior wall of the vent system components 130, 140, 150, 170. It may be advantageous to seal this region using adapters 210, 220.

Figure 3:
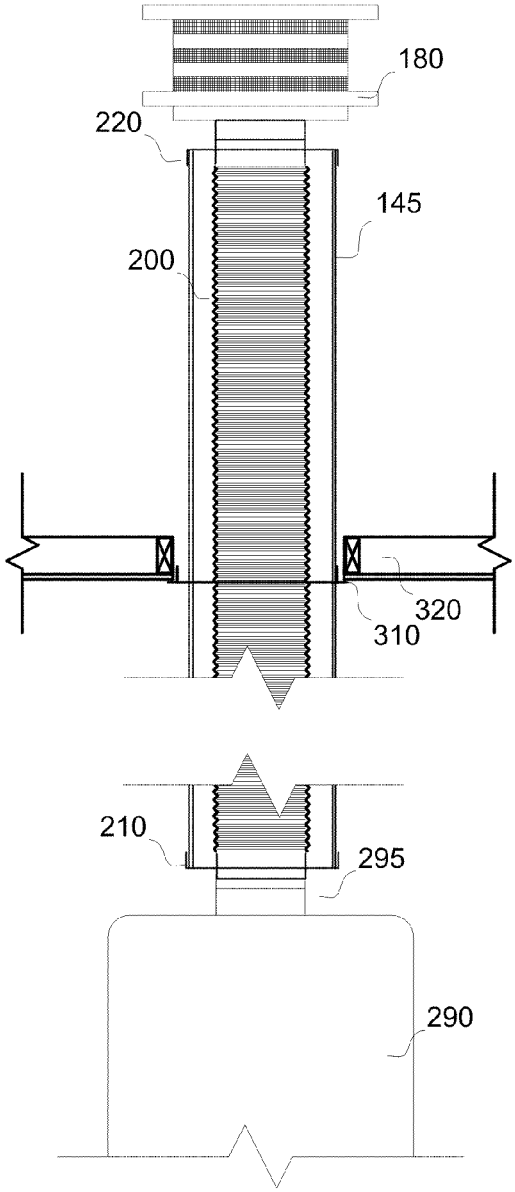
FIG. 3 depicts a conventional Category II, III or IV appliance adapters for use with the venting system described herein.
Figure 4A:
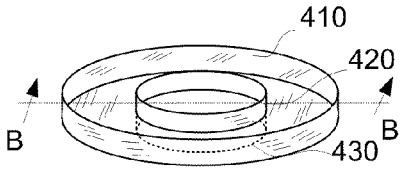
FIGS. 4A-4B are views of a first embodiment of an adapter shown in FIG. 3.
Figure 4B:
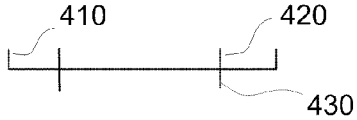

FIGS. 3-4B illustrate the use of adapters 210, 220 with the venting system according to the present technology. As shown in FIG. 3, a first adapter 220 may be positioned between one end of the vent material 200 and the vent cap 180, or between vent 200 and a vent pipe extension (not shown) and cap 180. A second adapter 210 is positioned between a second end of the vent material 200 and the appliance connector 295

FIG. 4A is an isometric view and FIG. 4B is a cross-sectional view along line B-B in FIG. 4A of a typical adapter for use in the present technology. The adapter has an outer ring 410 positioned to surround the end of the outer vent component, such as component 210. An adapter fitting 420 allows the inner vent material 200 to be coupled to the adapter. Coupling the inner vent material to the fitting 420 and the outer ring to the outer vent material seals one end existing vent system 100. An outer fitting 430 is providing to couple the adapter to the appliance. In a similar manner, a second adapter 210 uses an inner fitting 420 to couple the second end of the inner vent material 200 and an outer fitting to engage the vent cap 180.

Figure 4C:
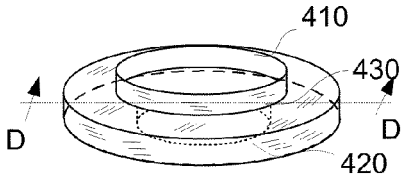
FIGS. 4C and 4D are a second embodiment of an adapter shown in FIG. 3.
Figure 4D:
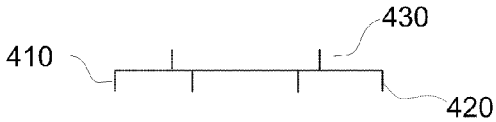

In the illustration in FIG. 4A, 4B and FIG. 3, the outer fitting appears with the same diameter as the inner fitting. However, it will be recognized that the inner fitting 420 and the outer fitting 430 may have different sizes, and cross-sectional shapes, depending on the components to which they are to be coupled. An adapter with different diameter inner and outer fittings is illustrated in FIGS. 4C and 4D. The adapter used in FIGS. 4C and 4D is useful where, for example, the vent cap 180 is designed to be used with the larger diameter of the existing vent system components 100.

While each adapter 210, 220 is discussed herein as being equivalent in structure, it will be recognized that each adapter may be appropriately sized depending on the diameter of the components of vent system 100 as well as the vent material 200. In addition, although the vent adapters are illustrated as having a generally circular shape, the cross-section of the adapter will be formed to match the shape of the interior vent material 200 cross-section as well as well as the vent system 100 cross section.

Figure 5:
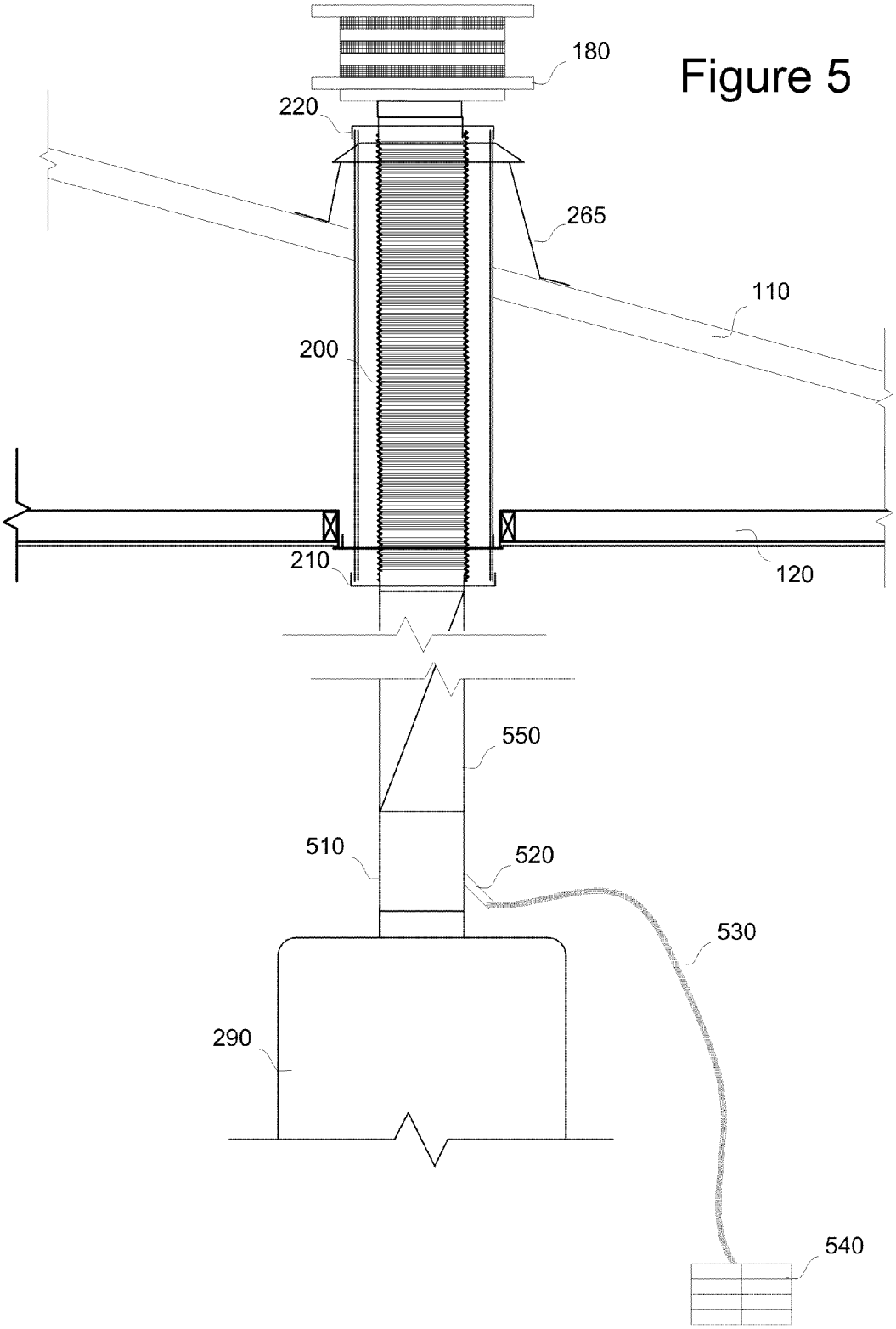
FIG. 5 depicts a conventional Category II, III or IV appliance with a condensate drainage system for use with the venting technology.
Figure 6:
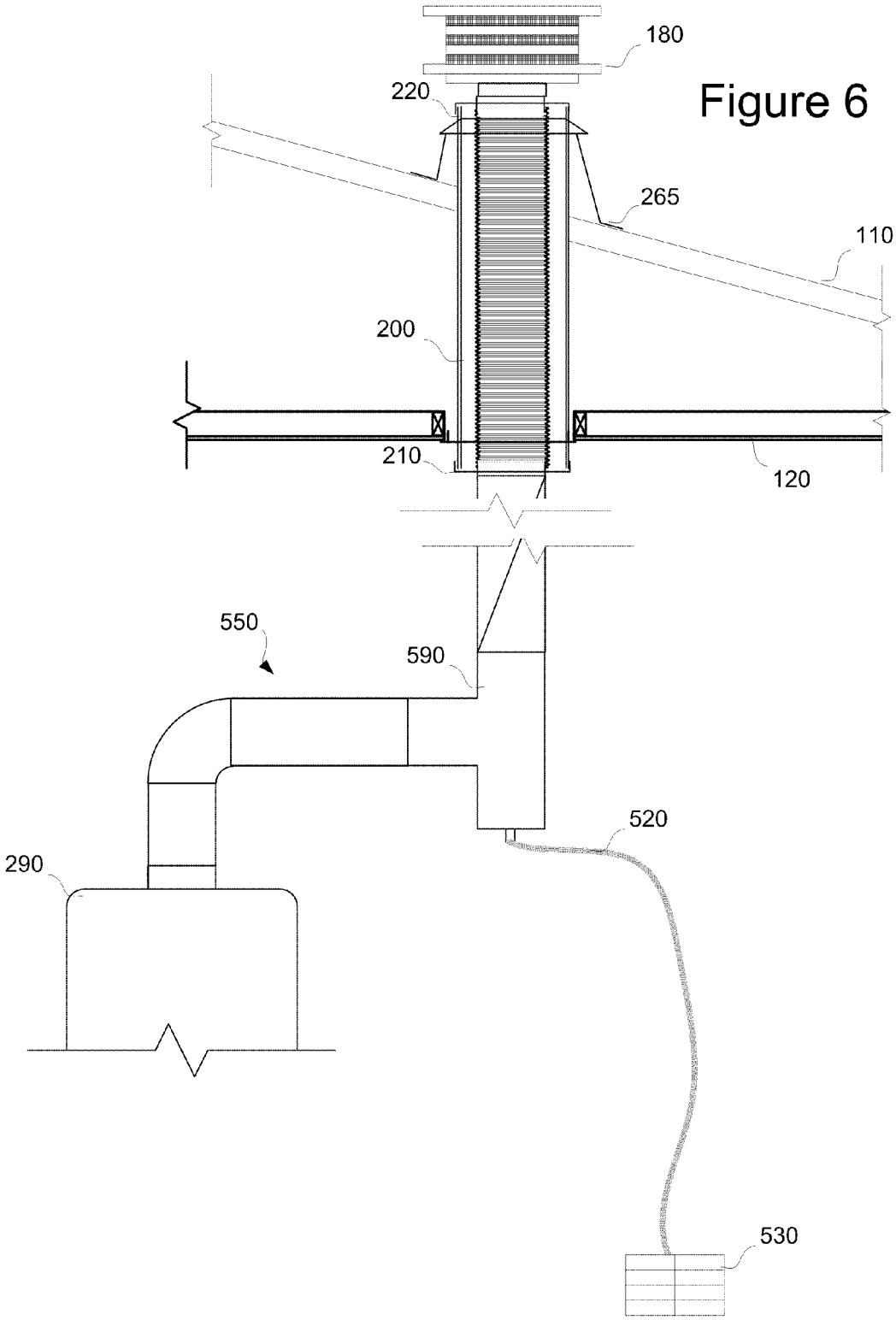
FIG. 6 depicts a conventional Category II, III or IV appliance with a second embodiment of a condensate drainage system for use with the venting technology.

FIGS. 5 and 6 illustrate various embodiments of a condensate drain adapter for use with the present technology. If a Category II or IV system is in use, condensate may accumulate in the inner vent material 200 and some form of drainage system must be provided to remove the condensate from the vent system. FIG. 5 illustrates an embodiment wherein the Category II or IV vent material components are couple to an adapter positioned at the end of the existing category I system. In the system of FIG. 5, the existing system 100 is used for the limited purpose of extending the interior vent material 200 though combustibles. Accessible portions of the building may allow for installation of additional components 550 of Category II, III or IV materials leading to the coupling with the appliance 290. In the embodiment of FIG. 5, a condensate drain adapter 510 allows the coupling of a drainage hose 520 to a spigot 530 to remove condensate to a drain 540. FIG. 5 also illustrates that use of the existing vent system 100 allows maintaining the existing flashing and storm collar, further easing the installation of the venting system when installing a new Category II, III or IV appliance.

FIG. 6 illustrates an alternative use of a t-adapter 590 having condensate drain spigot adapted in the same manner as the system of FIG. 5 to couple a drainage hose 520 to a spigot 530 to remove condensate to a drain 540.

What is claimed is:

1. A venting system comprising:

a non-flexible metallic venting pipe comprising a chase, having a first end positioned adjacent an appliance installation and a second end positioned at an exit to an external region of a home, the metallic venting pipe having a first diameter adapted to couple to a vent cap at the second end, the vent cap having a reciprocal diameter adapted to mate with the first diameter, the first diameter adapted to mate directly to an exhaust of a first type of combustion appliance at the first end;

a flexible stainless steel vent tube comprising a non-corrosive metal, having a first end and a second end, the vent tube positioned between the first end of the venting pipe and the second end of the venting pipe, the vent tube having a second diameter smaller than the first diameter, the second diameter adapted to couple directly to an exhaust of a second type of combustion appliance and mate with the vent cap to provide an exhaust path between the exhaust of the second type of combustion appliance and the vent cap; and the vent tube comprising a material to allow condensate from the appliance to remain within the vent tube under positive and negative venting pressure when the vent tube is coupled to the exhaust.

2. The system of claim 1 wherein the chase is installed in a structure to provide at least one inch clearance between the chase and any combustibles.

3. The system of claim 1 further including:

a first adapter positioned at the first end of the venting pipe; and a second adapter positioned at the second end of the venting pipe, wherein each adapter creates a seal the between the vent pipe and the vent tube.

4. The system of claim 3 wherein the vent pipe has a first diameter, the vent tube has a second diameter, and the first adapter comprises a fitting at a first coupling engaging said vent pipe and a second coupling engaging said vent tube, the fitting creating a seal the between the vent pipe and the vent tube.

5. The system of claim 4 wherein the second adapter comprises a fitting at the second end of the pipe having a first coupling engaging said vent pipe and a second coupling engaging said vent tube, the fitting creating a seal the between the vent pipe and the vent tube, the second adapter further including a third coupling having a third diameter, the third coupling engaging one of a Category II, Category III or Category IV compliant venting extension pipe or an exhaust outlet.

6. The system of claim 3 wherein the first adapter comprises a fitting at the end of the venting pipe which seals the vent pipe and allows the flexible vent tube to pass there through.

7. The system of claim 3 wherein the second adapter comprises a fitting at the second end of the pipe which seals the vent pipe and allows the flexible vent tube to couple to the second type of appliance.

8. The system of claim 1 wherein the second type of combustion appliance is a Category II, III or IV appliance.

9. A venting system comprising:

a flexible steel vent tube comprising a sealed non-corrosive steel, having a first end and a second end, the vent tube positioned in a non-flexible metallic venting pipe comprising a chase, the chase having a first end positioned adjacent an appliance installation and a second end positioned at an exit to an external region of a home, the vent tube having a second end positioned at the exit to an external region of a home, the metallic venting pipe having a first diameter adapted to couple to a first vent cap at the second end, the vent cap having a reciprocal diameter adapted to mate with the first diameter, the first diameter adapted to mate directly to an exhaust of a first type of combustion appliance at the first end, the flexible steel vent tube having a second diameter smaller than the first diameter, the second diameter adapted to couple directly to an exhaust of a second type of combustion appliance and mate with the vent cap to provide an exhaust path between the exhaust of the second type of combustion appliance and the vent cap;

the vent tube comprised of a non-corrosive material to thereby allow condensate from the appliance within the vent tube under positive and negative venting pressure.

* * * * *

UNITED STATES PATENT AND TRADEMARK OFFICE

CERTIFICATE OF CORRECTION

PATENT NO. : 9,140,450 B2
APPLICATION NO. : 12/427576
DATED : September 22, 2015
INVENTOR(S) : Jacklich et al.

It is certified that error appears in the above-identified patent and that said Letters Patent is hereby corrected as shown below:

In the Claims

Column 5, line 25, claim 3: After “seal” and before “between”, please delete “the”.

Column 5, line 31, claim 4: After “seal” and before “between”, please delete “the”.

Column 5, line 36, claim 5: After “seal” and before “between”, please delete “the”.

Signed and Sealed this
Nineteenth Day of April, 2016

Michelle K. Lee

Michelle K. Lee
*Director of the United States Patent and Trademark Office*